United States Patent [19]

Welch

[11] Patent Number: 5,071,115

[45] Date of Patent: Dec. 10, 1991

[54] EXERCISE DEVICE FOR SIMULATING WALKING AND STAIR CLIMBING

[76] Inventor: Robert M. Welch, 2130 NW. 40th St., Oklahoma City, Okla. 73112

[21] Appl. No.: 615,595

[22] Filed: Nov. 19, 1990

[51] Int. Cl.[5] ..... A63B 23/04

[52] U.S. Cl. ..... 272/70; 272/140

[58] Field of Search ..... 272/65, 66, 72, DIG. 4, 272/140, 70, 130, 69, 96, 94, 93, 134, 132

[56] References Cited

U.S. PATENT DOCUMENTS

| | | | |
|---|---|---|---|
| 3,628,791 | 12/1971 | Garcia | 272/DIG. 4 |
| 4,684,126 | 8/1987 | Dalebout et al. | 272/72 |
| 4,750,735 | 6/1988 | Furgerson et al. | 272/72 |
| 4,838,543 | 6/1989 | Armstrong et al. | 272/70 |

*Primary Examiner*—Stephen R. Crow

[57] ABSTRACT

An exercise device for simulating walking and stair-climbing and providing low impact aerobics for exercising the lower body. The exercise device includes a frame mounted on a base. The frame includes an upright standard mounted on a front of the base and angled rearwardly. A handle bar with handle bar grips is attached to a top of the standard. An upper end of a pair of hydraulic cylinders is attached to the standard. A lower end of the hydraulic cylinders is attached to a first and second independent step. A front pivot portion of the steps is mounted on a pivot shaft which is mounted on the standard. A pair of torsion springs is disposed around opposite ends of the pivot shaft. The torsion springs bias the steps upwardly at an angle above the horizontal. When a user of the exercise device steps on a rear step portion of the steps and downward pressure is applied on the first step, the cylinder telescopes downwardly and the torsion spring is flexed around the pivot staff. When downward pressure is applied on the second step and the pressure relieved from the first step, the second step moves downwardly as the first step returns to its upward position. By first applying pressure on one foot and lifting the other foot, a natural floating type simulation of climbing steps occurs when using the subject exercise device.

12 Claims, 1 Drawing Sheet

EXERCISE DEVICE FOR SIMULATING WALKING AND STAIR CLIMBING

BACKGROUND OF THE INVENTION

1. Field of the Invention

This invention relates to an exercise device and more particularly, but not by way of limitation, to an exercise device for simulating walking, stair climbing, and providing low impact aerobics for exercising the lower body.

2. Discussion of the Prior Art

Heretofore there have been a variety of prior art stair climbing exercise apparatus using endless chains and hydraulically controlled steps for simulating stair climbing. These exercise devices are described in U.S. Pat. No. 4,708,338 to Potts; U.S. Pat. No. 4,726,581 to Chang; U.S. Pat. No. 4,496,147 to DeCloux; U.S. Pat. No. 3,970,302 to McFee; U.S. Pat. No. 4,685,669 to DeCloux; and U.S. Pat. No. 4,685,666 to DeCloux. None of these above patents provide a combination of independent steps using a torsion spring return system with variable resistance shocks.

In U.S. Pat. No. 4,838,543 to Armstrong et al a popular low impact exercise device is described having a pair of foot beams pivotally mounted on a support frame. The foot beams are connected to a pair of shock absorbers and a rope and pulley system. Each foot beam is dependent on the other and as one beam moves down the other foot beam moves up. To obtain a full range of motion the end of the rope needs to be adjusted along the length of the foot beam. Also the rope and pulley system has proven to be a safety hazard when children with small fingers are found playing nearby. Futher when using an exercise device having dependant steps, each step must come to a momentary stop before its direction of travel can be reversed. This stop and go movement occurs from the waist down. It has been found that this unnatural movement can cause lower back pain. The abovementioned low impact exercise device does not incorporate the unique features of independent steps which provide a natural free floating sensation when exercising.

In West German Patent 2,243,794 to Schmidt a sports apparatus for leg exercising is disclosed with a pair of hinged bars having foot plates. Positioned under the hinged bars are adjustable coil springs. By standing on the foot plates the springs are compressed. The springs can be moved along the length of the hinged bars for adjusting the spring reaction force. While each foot plate can be operated independently, the exposed coil springs present a safety hazard. Further this sports apparatus does not disclose the unique combination of the features making up the subject invention.

SUMMARY OF THE INVENTION

An object of this invention is to provide a stair climbing exercise device with a pair of steps which are free floating and work independently of each other thereby avoiding an abrupt start and stop sensation when using dependent steps.

Another object of the invention is to provide an exercise device which is streamlined and simplistic in design, rugged in construction, and free of pulleys, ropes, cables, and coil springs that are safety hazards to children and adults alike.

Still another object of the exercise device is the use of torsion springs which should a spring break there are no flying parts. Further the springs are located out of sight under one end of each step and there is no danger of a small child getting their small fingers in between the coils of the torsion springs.

Yet another object of the invention is through the use of torsion springs with a proper thickness and sufficient coil windings the independant steps are returned at a nomimal speed to give the opserator of the device a natural feel of simulating walking and stair climbing.

Further another object of the exercise device is the use of variable resistance shocks in combination with the torsion return springs. By turning a knob on each shock the resistance can be increased for heavier users of the device and decreased for lighter weight individuals.

The subject exercise device for simulating walking and stair climbing includes a frame mounted on a base. The frame includes an upright standard mounted on a front of the base and angled rearwardly. A handle bar with handle bar grips is attached to a top of the standard. An upper end of a pair of variable resistance hydraulic cylinders is attached to the standard. A lower end of the hydraulic cylinders is attached to a first and second independant step. A front pivot portion of the steps is mounted on a pivot shaft which is secured to the standard. A pair of torsion springs is disposed around opposite ends of the pivot shaft. The torsion springs bias the steps upwardly at an angle above the horizontal. When a user of the exercise device steps on a rear step portion of the steps and downward pressure is applied on the first step the cylinder telescopes downwardly and the torsion spring is flexed around the pivot shaft. When downward pressure is applied on the second step and the pressure is relieved from the first step, the second step moves downwardly as the first step returns to its upward position. By first applying pressure on one foot and lifting the other foot, a natural floating type simulation of walking and stair climbing occurs when using the subject exercise device.

These and other objects of the present invention will become apparent to those skilled in the art from the following detailed description, showing the contemplated novel construction, combination and elements as herein described, and more particularly defined by the appended claims, it being understood the changes in the precise embodiments of the herein disclosed invention are meant to be included as coming within the scope of the claims, except insofar as they may be precluded by the prior art.

DESCRIPTION OF THE PREFERRED EMBODIMENT

Figure 1:
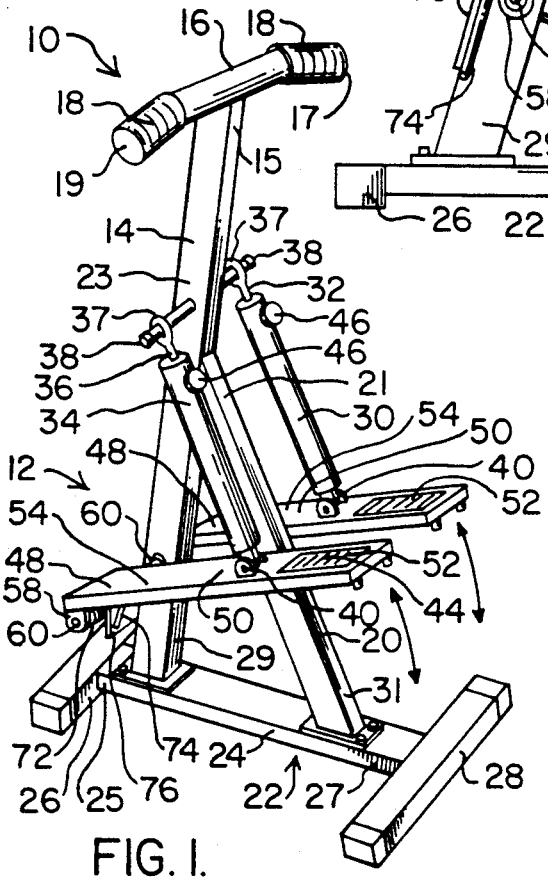
FIG. 1 is a perspective view of the subject exercise device having a pair of independent steps pivotally mounted on a frame with both steps biased in an "Up" position by torsion springs.

In FIG. 1 the subject exercise device is designated by general reference Character 10. The device 10 includes a frame 12 made up of an upright standard 14 with a handle bar 16 mounted on a top portion 15 of the standard 14. The handle bar 16 includes a pair of handle bar grips 18 mounted on opposite ends 17 and 19 of the handle bar 16. The frame 12 further includes an upright angle brace 20 having an upper end 21 secured to a middle portion 23 of the standard 14. From reviewing the perspective of the device 10 in FIG. 1, it can be seen that the standard 14 is angled from the vertical in a range of a 1 o'clock position while the angle brace 20 is angled from the vertical in a range of a 10 o'clock position. The frame 12 is mounted on top of an "I" shaped base 22. The base 22 includes a frame support bar 24 having a front end 25 attached to a front cross bar 26 and a rear end 27 attached to a rear cross bar 28. A bottom portion 29 of the standard 14 is secured near the front end 25 of the support bar 24. A lower end 31 of the angle brace 20 is secured near the rear end 27 of the support bar 24.

A first hydraulic cylinder 30 and piston 32 and a second hydraulic cylinder 34 and piston 36 are attached at an upper end to the middle portion 23 of the standard 14. A bushing 37 is mounted on the end of the pistons 32 and 36 and is secured to a pair of horizontal piston connecting rods 38 attached to opposite sides of the standard 14. At a lower end of the cylinders 30 and 34 is a cylinder connecting bracket 40 which is used for securing the cylinder 30 to a first independent step 40 and cylinder 34 to a second independent step 42. Each of the cylinders 30 and 34 have a variable resistance control knob 46. By rotating the knob 46 clockwise the resistance in lowering the steps 42 and 44 and extending the pistons 32 and 36 from the cylinders 30 and 34 is decreased. This is helpful for lighter weight users of the device 10 or those who wish to increase the speed of the stair climbing simulation. Likewise by rotating the knobs 46 in a counterclockwise direction the resistance in lowering the steps 42 and 44 and extending the pistons 32 and 36 from the cylinders 30 and 34 is increased. A user of the device 10 having a greater weight or wishing more resistance in the walking or stair climbing simulation would turn the knobs 46 counterclockwise.

In FIG. 1 the steps 42 and 44 are shown in an "Up" position at an angle in the range of 30 degrees above the horizontal. In the "Up" position the pistons 32 and 36 are fully retracted in the cylinders 30 and 34 and the independent steps 42 and 44 are at rest. The independent steps 42 and 44 include a front pivot portion 48, a middle portion 50, a rear step portion 52, a top 54, and a bottom 56. Each of the cylinder connecting brackets 40 are attached to the middle portion 50 of the steps 42 and 44. The rear step portion 52 is used for receiving the bottom of the foot of the person using the device 10. The front pivot portion 48 is used for receiving a pivot shaft bracket 58 on the bottom 56 of the steps 42 and 44. The pivot shaft brackets 58 receive a first end 61 and a second end 63 of a horizontal pivot shaft 60. The pivot shaft 60 with ends 61 and 63 is shown in its entirety in FIG. 2. The pivot shaft 60 extends through and is attached to opposite sides of the bottom portion 29 of the upright standard 14.

Figure 2:
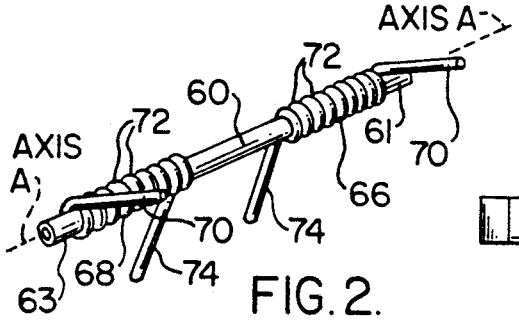
FIG. 2 is a perspective view of a pivot shaft with a pair of the torsion springs disposed thereon.

A first torsion spring 66, shown in FIG. 2, is wrapped around the first end 61 of the pivot shaft 60 and a second torsion spring 68 is wrapped around the second end 63 of the pivot shaft 60. The two springs 66 and 68 provide a constant force in biasing the independent steps 42 and 44 in their "Up" position as shown in FIG. 1.

In FIG. 2 a perspective view of the two helical torsion springs 66 and 68 wrapped around the pivot shaft 60 is shown removed from the exercise device 10. The pivot shaft 60 has a pivot axis A which is also the coil axis of the two springs 66 and 68. The springs 66 and 68 are loaded by a torque about the axis A. The primary stress in this type of spring is flexural in contrast to helical compression and tension springs where the primary stress is torsional. The design of the spring end of a torsion spring is to transmit external torque to the spring coils.

Each of the springs 66 and 68 have an outwardly extending pivot arm 70, a plurality of coils 72 wrapped around a portion of the pivot shaft 60, and an outwardly extending stationary arm 74. The coils 72 are closely spaced next to each other so that during the operation of the device 10 as the springs 66 and 68 are flexed on the pivot shaft 60 any small fingers placed under the steps 42 and 44 will not be pinched and hurt. The stationary arms 74 are held in place by a flat angular keeper 76 attached to a portion of the standard 14. The flat angular keeper 76 can be seen in a front view in FIG. 4 with a portion of the arms 74 resting against the back side of the keeper 76. The pivot arms 70 shown in FIG. 2 are in a resting or non-flexed postion at an angle in the range of 30 degrees above the horizontal. The pivot arms 70 engage the bottom 56 of the front pivot portion 48 of the two independent steps 42 and 44.

Figure 3:
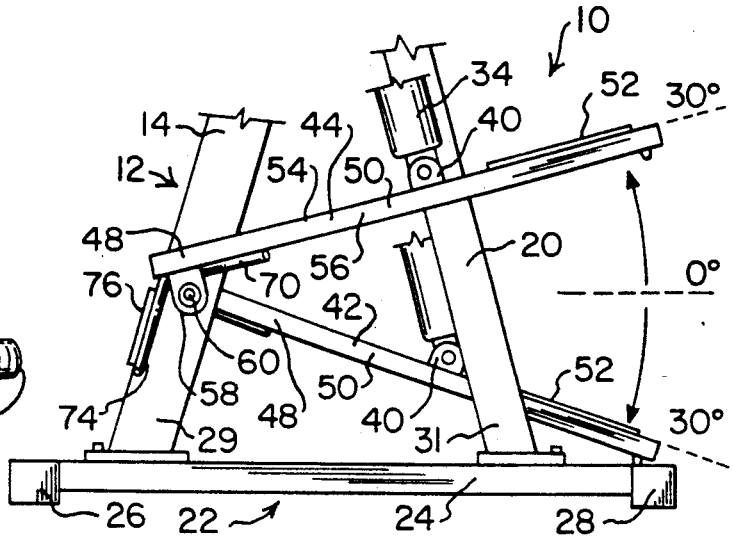
FIG. 3 is a side view of a lower half of the exercise device with one of the independent steps in an "Up" postion and the other step in a "Down" position.
Figure 4:
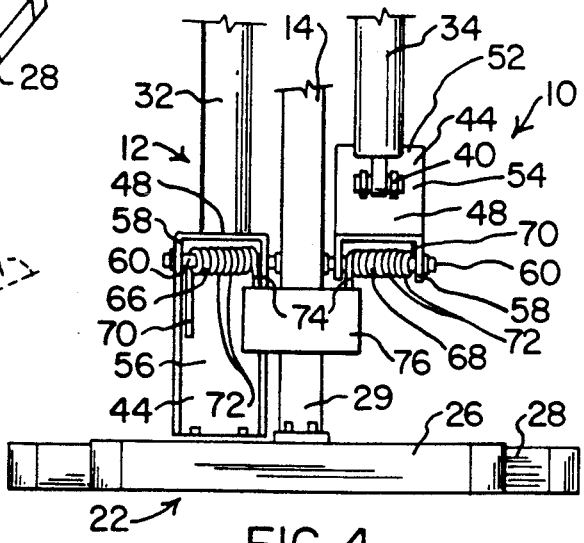
FIG. 4 is a front view of the lower half of the exercise device as shown in FIG. 3.

In FIG. 3 a lower side view of the exercise device 10 is shown with the first independent step 42 lowered into a "Down" position with the bottom 56 of the rear step portion 52 contacting the rear cross bar 28 of the base 22. In this position the step 42 has moved from its resting or "Up" position in a range of 30 degrees above the horizontal, downward to the "Down" position in a range of 30 degrees below the horizontal. Therefore, it can be seen that the steps 40 and 42 have an operating range of approximately 60 degrees. When either of the steps 40 or 42 move downward to the "Down" position, the torsion springs 66 and 68 in turn are provided with an external torque applied by each step moving the pivot arm 70 from its resting position as shown in FIG. 2 to a flexed position as shown in FIG. 3 and FIG. 4. The torsion springs 66 and 68 are designed to withstand an external torque of a 90 degree deflection or greater. Therefore, with the range of deflection around 60 degrees, the springs wear life and longevity are insured. Also, the torsion springs 66 and 68 are designed with sufficient coil windings and wire thickness to return each step 42 and 44 at a nominal speed to its rest or "Up" position along with providing a natural feel of walking and stair climbing.

In FIG. 4 a lower fron view of the exercise device 10 is shown with the steps 42 and 44 in the same positions as shown in FIG. 3. In this view the torsion springs 66 and 68 can be seen around the pivot shaft 60 with the stationary arms 74 disposed against the angular keeper 76. The pivot arm 70 of the torsion spring 66 has been deflected by the first independent step 42 into a "Down" position. The pivot arm 70 of the torsion spring 68 is partially hidden underneath the second independent step 44 shown in an "Up" position. Also, as each step 44 moves downward the pistons 32 and 36 extend outwardly from the cylinders 30 and 34. This feature is not shown in the drawings.

In operation the user of the exercise device 10 first adjusts the resistance control knobs 46 for either increasing or decreasing the resistance of the hydraulic cylinders 30 and 34. Also, the resistance can always be adjusted during the exercise period. The user then places both feet on the rear step portion 52 of the independent steps 42 and 44. If no pressure is applied to either step 42 or 44 the user will slowly be lowered to where both of the steps touch the rear cross bar 28 of the base 22. If the user steps off either step the torsion springs 66 and 68 return the steps to the "Up" position as shown in FIG. 1. When the user applies pressure to the step 42 this step is lowered until the pressure is relieved. Because each of the steps 43 and 44 operate independently of each other, at any time pressure can be applied to the second step 44. As the second step 44 begins to lower the user relieves the pressure to the first step 42. As this motion is repeated a natural walking and stair climbing motion occurs.

While the invention has been particularly shown, described and illustrated in detail with reference to preferred embodiments and modifications thereof, it should be understood by those skilled in the art that the foregoing and other modifications are exemplary only, and that equivalent changes in form and detail may be made therein without departing from the true spirit and scope of the invention as claimed, except as precluded by the prior art.

I claim:

1. An exercise device for simulating walking and stairclimbing, the device comprising:

an upright standard having a lower end mounted on a floor engaging base;

grip means attached to an upper end of the standard for holding when using the device;

a pair of variable resistance shocks having an upper end attached to the standard;

a pair of independent steps attached to a lower end of the shocks, the steps having a front pivot portion pivotally mounted on a pivot shaft attached to the standard; and biasing means disposed on pivot shaft and engaging the steps for providing resistance in lowering the steps and for providing a bias force in raising the steps;

said biasing means is a pair of torsion springs each having a stationary arm engaged against the standard and a pivot arm engaged against the front pivot portion of the steps, said torsion springs having a plurality of coils received around opposite ends of the pivot shaft, whereby the torsion springs bias the independent steps upwardly and the resistance shocks hold the steps in a resting position at an angle in a range of 30 degrees above the horizontal.

2. The exercise device as described in claim 1 wherein the upright standard is part of a frame having an upright angle brace having an upper end attached to the standard, the upright standard and upright angle brace having lower ends mounted on the floor engaging base.

3. The exercise device as described in claim 2 wherein the floor engaging base is "I" shaped with a front cross bar, a rear cross bar, and opposite ends of a frame support bar attached to the front cross bar and rear cross bar, the lower ends of the standard and angle brace mounted on the frame support bar.

4. The exercise device as described in claim 1 wherein the shocks include variable resistance control knobs thereon for increasing and decreasing the resistance of the shocks.

5. The exercise device as described in claim 1 wherein the grip means is a handle bar having handle bar grips at opposite ends of the handle bar.

6. The exercise device as described in claim 1 wherein the independent steps include a middle portion attached to the lower end of the shocks and a rear step portion for a user of the device to place his or her feet on.

7. An exercise device for simulating walking and stairclimbing, the device comprising:

an upright standard having a lower end mounted on a floor engaging base;

grip means attached to an upper end of the standard for holding when using the device;

a pair of independent steps pivotally mounted on a pivot shaft attached to the standard;

resistance means attached at one end to the standard and at another end to the independent steps for providing resistance when the steps are lowered; and biasing means disposed on the pivot shaft and engaging the steps for providing additional resistance in lowering the steps and for providing a bias force in raising the steps;

said biasing means is a pair of torsion springs having a plurality of coils with one end extending outwardly as a stationary arm and another end extending outwardly as a pivot arm, the coils received around the opposite ends of the pivot shaft, the stationary arms engaging a keeper attached to the standard, and the pivot arms engaging the independent steps, whereby the torsion springs bias the independent steps upwardly and the resistance shocks hold the steps in a resting position at an angle in a range of 30 degrees above the horizontal.

8. The exercise device as described in claim 7 wherein the resistance means is a pair of variable resistance shocks having an upper end attached to the standard and a lower end attached to the independent steps.

9. The exercise device as described in claim 7 wherein the independent steps include a front pivot portion, a middle portion, and a rear step portion, the front pivot portion engaged by the biasing means and the middle portion attached to another end of the resistance means.

10. An exercise device for simulating walking and stairclimbing, the device comprising:

an upright standard having a lower end mounted on a floor engaging base;

a handle bar attached to an upper end of the standard for holding when using the device;

a pair of resistance shocks having an upper end attached to opposite sides of the standard;

a pair of independent steps attached to a lower end of the shocks, the steps having a front pivot portion pivotally mounted on a pivot shaft attached to the standard; and a pair of torsion springs having a plurality of coils with one end extending outwardly as a stationary arm and another end extending outwardly as a pivot arm, the coils received around opposite ends of the pivot shaft and disposed next to the standard, the stationary arms engaging a keeper attached to the standard, and the pivot arms engaging a bottom of the front pivot portion of the independent steps;

whereby the torsion springs bias the independent steps upwardly and the resistance shocks hold the steps in a resting position at an angle in a range of 30 degrees above the horizontal.

11. The exercise device as described in claim 10 wherein the motion of the independent steps is in a range of 30 degrees above the horizontal in a resting and retracted position to a range of 30 degrees below the horizontal in a lowered and extended position.

12. The exercise device as described in claim 10 wherein the pivot arms of the torsion springs can be pivoted up to 90 degrees and greater on the pivot shaft without breaking the torsion springs.

* * * * *